United States Patent [19]

Pearl

[11] 4,444,078

[45] Apr. 24, 1984

[54] APPARATUS FOR CUTTING SHEET MATERIAL

[75] Inventor: David R. Pearl, West Hartford, Conn.

[73] Assignee: Gerber Garment Technology, Inc., South Windsor, Conn.

[21] Appl. No.: 345,707

[22] Filed: Feb. 4, 1982

[51] Int. Cl.[3] ..... B26D 7/06; B65H 35/00

[52] U.S. Cl. ..... 83/374; 83/39; 83/100; 83/71; 83/925 R; 269/21

[58] Field of Search ..... 83/39, 374, 100, 925, 83/71, 422, 451, 217, 263; 269/21; 355/73

[56] References Cited

U.S. PATENT DOCUMENTS

| | | | |
|---|---|---|---|
| 2,680,994 | 6/1954 | Wood | 269/21 |
| 3,307,819 | 3/1967 | Cocito | 269/21 |
| 3,495,492 | 2/1970 | Gerber et al. | 83/451 |
| 3,865,359 | 2/1975 | Caroli | 269/21 |
| 3,907,268 | 9/1975 | Hale | 269/21 |
| 4,328,726 | 5/1982 | Pearl | 83/39 |
| 4,345,496 | 8/1982 | Pearl | 83/100 |
| 4,378,155 | 3/1983 | Nygaard | 355/76 |

*Primary Examiner*—Donald R. Schran

*Attorney, Agent, or Firm*—McCormick, Paulding & Huber

[57] ABSTRACT

A sheet material cutting apparatus has a vacuum table with openings in its surface and a cutter wheel which moves in engagement with the table surface to cut sheet material spread on the surface. A valve is movable within each opening between an open and closed position. Each valve moves to its closed position within its associated opening in response to movement of the cutter wheel to a predetermined position relative to the associated opening. Each valve in its closed position defines a portion of the table surface.

22 Claims, 7 Drawing Figures

APPARATUS FOR CUTTING SHEET MATERIAL

BACKGROUND OF THE INVENTION

This invention relates in general to apparatus for cutting sheet material and deals more particularly with improved apparatus for cutting pattern pieces from a single sheet or a layup comprising relatively few sheets of material and having a cutter which moves in cutting engagement with a bearing surface upon which sheet material to be cut is spread.

In an apparatus of the aforedescribed general type, the sheet material to be cut must be retained in firmly fixed position on the bearing surface so that it cannot shift during the cutting operation. Heretofore, apparatus of the aforedescribed type has been provided wherein sheet material to be cut is adhered to a bearing surface. One such apparatus utilizes a tacky coating on its bearing surface which cooperates with sheet material to releasably hold it in relatively firmly fixed position. While such apparatus has proven generally satisfactory, a new coating of tacky material must be periodically applied to the supporting or bearing surface to maintain the apparatus in proper working condition. This resurfacing operation necessitates costly machine downtime. Further, this arrangement is not particularly satisfactory for holding a layup which comprises a plurality of stacked plies, because the tacky material engages and holds only the lowermost ply of the layup. The sheets or plies thereabove may be prone to shifting movement when engaged by the cutter despite frictional engagement between adjacent plies.

Electrostatic holddown apparatus has also been used successfully to secure a single ply or layup comprising a relatively few plies of material in fixed position on a bearing surface, however, considerably auxiliary equipment is required for generating a force field which makes such apparatus costly to produce.

Vacuum holddown devices of the type which produce subatmospheric pressure at a work or bearing surface on which sheet material is spread have gained widespread acceptance in the material cutting art. A vacuum holddown device of the latter type is illustrated and described in U.S. Pat. No. 3,772,949 to Pavone et al for *Method and Apparatus for Cutting Sheet Material,* issued Nov. 20, 1973. The apparatus illustrated and described in the aforesaid patent includes a cutting wheel which rolls in cutting engagement with a bearing surface which has an array of openings therethrough communicating through channels with a vacuum pump. The patented apparatus is particularly adapted to cut anisotropic sheet materials, such as fibrous composite tapes which have different cutting characteristics along different principle axes. However, problems may be encountered when such apparatus is used to cut other types of materials, as, for example, woven fabrics. As the cutting instrument passes over holes in the bearing surface, threads which comprise the fabric may be forced into the holes by the cutting instrument rather than being cut by it. As a result, pattern pieces cut from the fabric are not easily separated from the waste material produced by the cutting operation. Further, failure to effect clean shearing of all of the threads which comprise the fabric may result in cut pattern pieces with rough or ragged edges. The present invention is primarily concerned with the aforesaid problems.

SUMMARY OF THE INVENTION

An apparatus for cutting sheet material has a bearing surface which has openings therethrough and which supports sheet material to be cut. The apparatus further includes a cutting instrument, means for moving the cutting instrument in engagement with the bearing surface to cut the sheet material spread thereon, a vacuum source, and means communicating with the vacuum source and with the openings in the bearing surface for applying vacuum to sheet material spread on the bearing surface. In accordance with the present invention, closure elements are movable between open and closed positions relative to the openings in the bearing surface for opening and closing the openings. The closure elements have surfaces disposed generally within the plane of the bearing surface when the closure elements are in closed positions. Means is provided for moving at least one of the closure elements to its closed position relative to an associated one of the openings in response to movement of the cutting instrument to a predetermined position relative to the one opening.

DETAILED DESCRIPTION OF PREFERRED EMBODIMENTS

Figure 1:
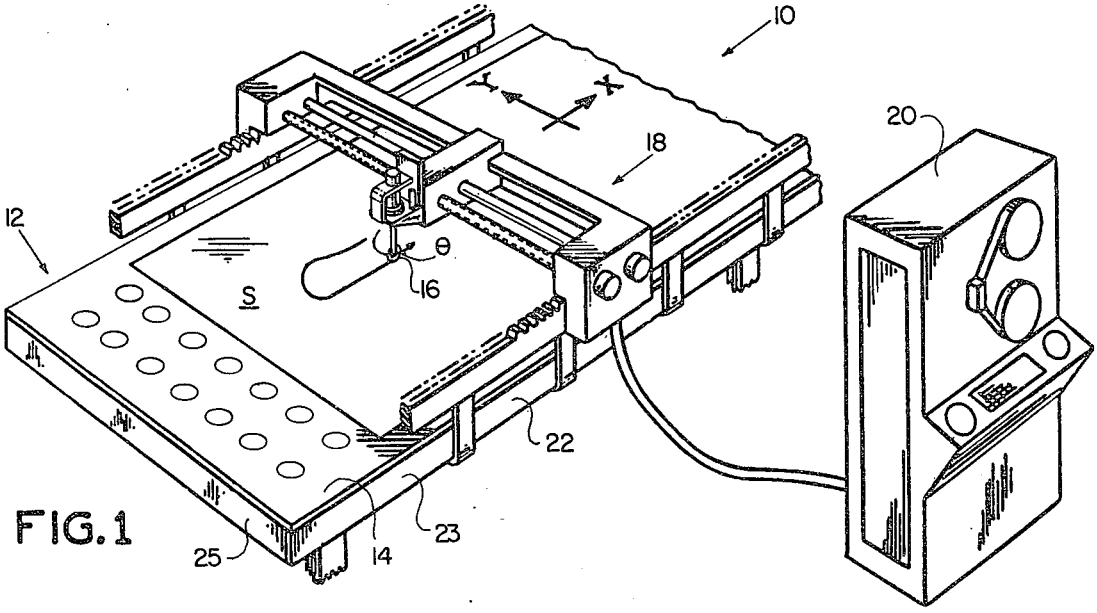
FIG. 1 is a perspective view of a cutting apparatus embodying the present invention.

Turning now to the drawings and referring first particularly to FIG. 1, a cutting apparatus embodying the present invention is indicated generally by the reference numeral 10. The apparatus 10 is particularly adapted for cutting a single sheet of material or a layup comprising a relatively few sheets of material arranged in stacked relation and generally comprises a vacuum holddown table assembly, designated generally by the numeral 12, which has a generally horizontally disposed bearing surface 14. The apparatus further includes a cutting instrument or cutter wheel 16 and a carriage assembly indicated generally at 18 for moving the cutting wheel 16 in rolling cutting engagement with the bearing surface 14 to cut sheet material spread thereon.

The carriage assembly 18 is supported on the table assembly 12 to move the cutter wheel 16 in longitudinal (X) and transverse (Y) coordinate directions relative to the bearing surface 14 in response to signals received from a programmable controller 20, in a manner well known in the art. The cutting wheel 16 is further arranged for angular movement about a $\theta$ axis generally perpendicular to the bearing surface 14 in response to further control signals from the controller 20. Thus, the cutter wheel 16 is arranged for rolling cutting engagement with the bearing surface to cut pattern pieces from sheet material which may, for example, comprise a single sheet, such as the sheet indicated by the letter S, or a layup which comprises a relatively few sheets of material arranged in vertically stacked relation and spread on the bearing surface 14. A more detailed description of apparatus of the aforedescribed type is found in the aforementioned patent to Pavone and in the patents cited therein which are hereby adopted by reference as part of the present disclosure.

Considering now the apparatus 10 in further detail, the illustrated table assembly 12 includes a table 22 which has a bottom wall 21, side walls 23, 23, and end walls 25, 25 (one shown) defining an upwardly open shallow cavity. The fluid permeable elastomeric sheet 24 is supported on the table 22 within the latter cavity. The bearing surface 14 is defined by a base plate 26 which is preferably made from metal and supported on the side walls 23, 23, and end walls 25, 25 above the elastomeric sheet 24. Preferably, and as shown, the base plate 26 is releasably secured to the side and end walls, so that it may be readily removed to serve as a pallet for handling and storing sheet material spread thereon. The base plate 26 cooperates with the bottom wall 21, the side walls 23, 23, and the end walls 25, 25, to define a chamber 27 containing the porous elastomeric sheet 24. The base plate 26 has an array of passageways 28, 28 extending through it which terminate at openings 30, 30. Each passageway 28 defines a conically upwardly diverging seating surface or valve seat 32 which terminates at an associated opening 30.

In accordance with the present invention, a plurality of closure elements or poppet valves 34, 34, equal in number to the passageways 28, 28 provide closures for the openings 30, 30. Each poppet valve 34 is supported within an associated passageway 28 for movement between open and closed position relative to an associated opening 30. A typical poppet valve 34, shown in FIG. 4, has a conical seating surface 36 which complements an associated valve seat 32, and an apex angle in the range of 60 to 90 degrees, as indicated by the numeral 40 in FIG. 4. The poppet valve 34 further includes a depending stem 41 which has a rounded lower end engaged with the elastomeric sheet 24. The sheet 24 maintains the poppet valve 34 in an open position, as it appears in full lines in FIG. 4. In the latter position the upper or closure surface, indicated by the numeral 42, is disposed above the bearing surface 14 a distance preferably in the range of 0.015 to 0.010 inches. When the poppet valve 34 is in its closed or broken line position of FIG. 4, the closure surface 42 is disposed generally within the plane of the bearing surface 14. In the latter position the upper peripheral edge of the closure element, indicated by the numeral 44, is substantially contiguous to the boundry region of an associated opening 30 so that the bearing surface 14 and the associated closure surface 42 cooperate to define a substantially smooth uninterrupted reaction surface.

Figure 3:
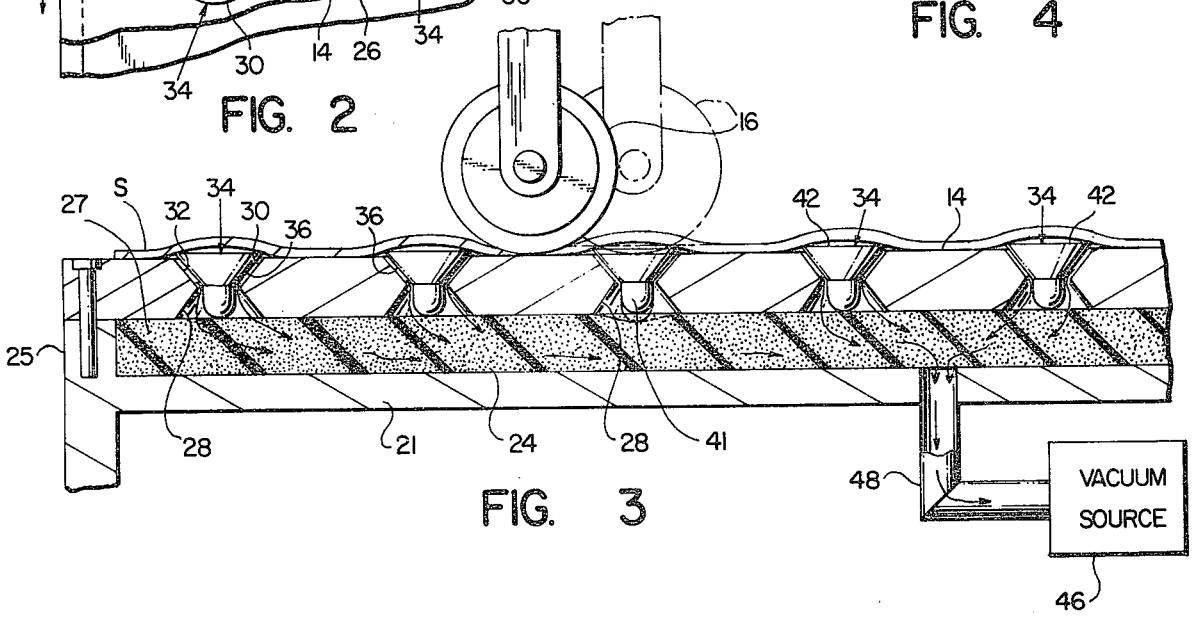
FIG. 3 is a fragmentary sectional view taken along the line 3—3 of FIG. 2, but shows the apparatus somewhat schematically.

A vacuum source, shown schematically in FIG. 3 and designated by the numeral 46 communicates with the passageways 28, 28 and the openings 30, 30 through the fluid permeable elastomeric sheet 24 and an associate conduit 48 connected between the vacuum source and the table bottom wall 21.

Figure 2:
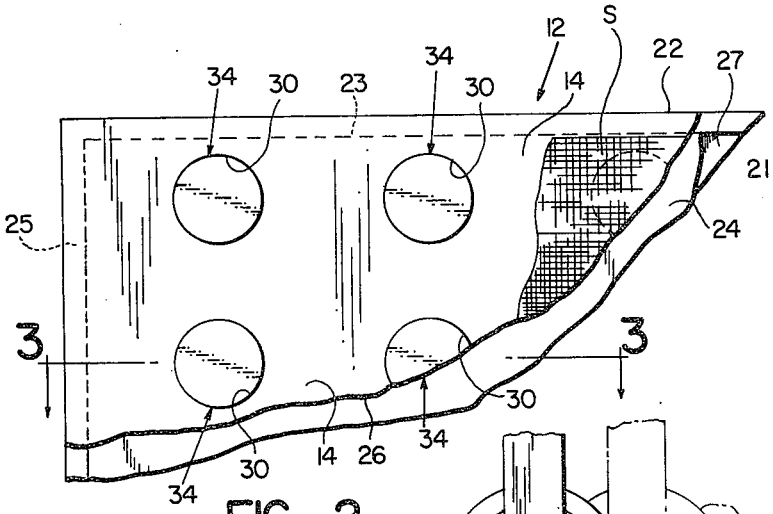
FIG. 2 is a somewhat enlarged fragmentary plan view of a portion of the apparatus shown in FIG. 1.

At the beginning of the cutting cycle vacuum is applied to the table by the vacuum source 46. The various poppet valves 34, 34 are normally maintained in open condition by the elastomeric sheet 24. As the cutting wheel 16 moves in rolling cutting engagement with the bearing surface 14 to cut a sheet of material spread on the bearing surface, such as the sheet S, it engages each poppet valve 34 in its path and moves the poppet valve to its closed position, as indicated by the broken line position of the cutter wheel 16 in FIG. 2. When the poppet valve is in its closed position its seating surface 36 is seated on an associated valve seat 32 and its closure surface 42 is substantially flush with the bearing surface 14. The closure surface and the associated portion of the bearing surface surrounding it present a substantially smooth uninterrupted surface over which the cutter wheel 16 may freely move in cutting engagement with the sheet S. Thus, the cutter wheel 16 will cleanly cut the sheet material S in the region of each opening 32 as the cutter wheel 16 progresses along the table 12 in response to programmed signals received from the controller 20.

In the apparatus 10 hereinbefore described, each closure element 34 in the path of the cutter wheel 16 is directly engaged and closed by the cutter wheel as it progresses along its cutting path in response to signals from the controller. However, in cutting some materials it may be desirable to provide for automatic closing of one of more closure elements in the path of the cutter wheel so that the associated opening or openings are closed before the advancing cutter wheel reaches the opening. This automatic closing of the closure element or elements occurs in response to movement of the cutter wheel to a predetermined position relative to an associated opening. Such an apparatus is hereinafter described.

Figure 4:
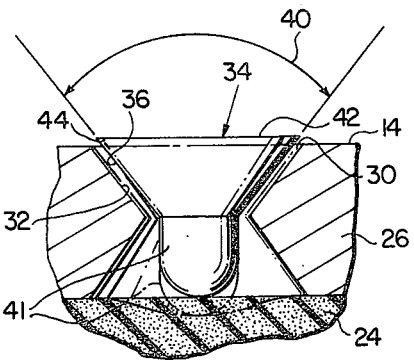
FIG. 4 is a somewhat further enlarged fragmentary sectional view of a portion of the apparatus as shown in FIG. 3.
Figure 5:
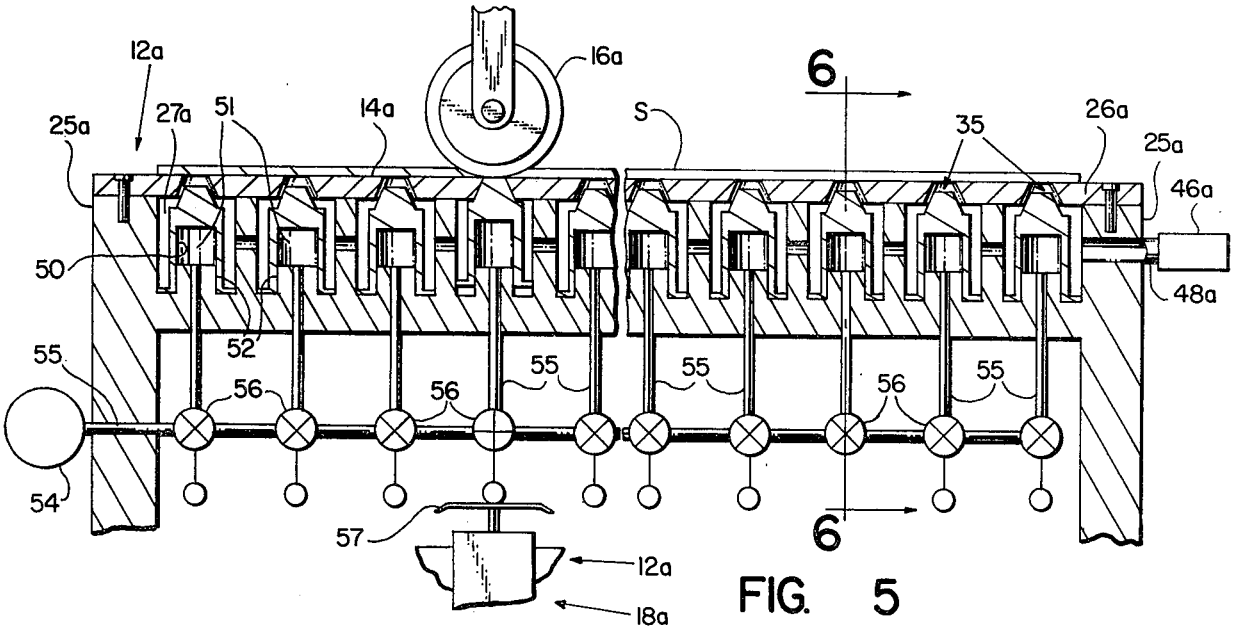
FIG. 5 is similar to FIG. 3 but shows another embodiment of the invention.

Referring now to FIGS. 4 and 5, another apparatus for cutting sheet material is illustrated and indicated generally by the reference numeral **10*a*. The apparatus 10*a* includes a vacuum holddown table assembly 12*a* and a cutter wheel 16*a* which is moved relative to the table assembly by an associated carriage assembly 18*a* shown schematically and substantially similar to the carriage assembly 18** previously described. The carriage assembly is driven in response to command signals received from an associated programmable controller or the like (not shown).

The table assembly **12*a* includes a table 22*a* which is a bottom wall 21*a*, opposing side walls 23*a*, 23*a*, and opposing end walls 25*a*, 25*a* which define a shallow upwardly open cavity. A rectangular base plate 26*a*, supported by the side walls 21*a*, 21*a*, and end walls 23*a*, 23*a*, cooperates with the latter walls and with the bottom wall 21*a* to define a chamber 27*a*. The base plate 26*a* has a longitudinally spaced series of transversely extending rows of conically upwardly diverging passageways 28*a*, 28*a*, which extend therethrough. Each passageway 28*a* defines a valve seat and terminates at an opening 30*a* through the upper surface of the base plate 26*a***.

A longitudinally spaced series of closure bars, indicated generally at 35, 35 in FIG. 5, are disposed within the chamber **27*a*. Each closure bar 35 extends transversely of the table 12*a*, as best shown in FIG. 6, and is associated with a row of openings 28*a*, 28*a***.

Figure 6:
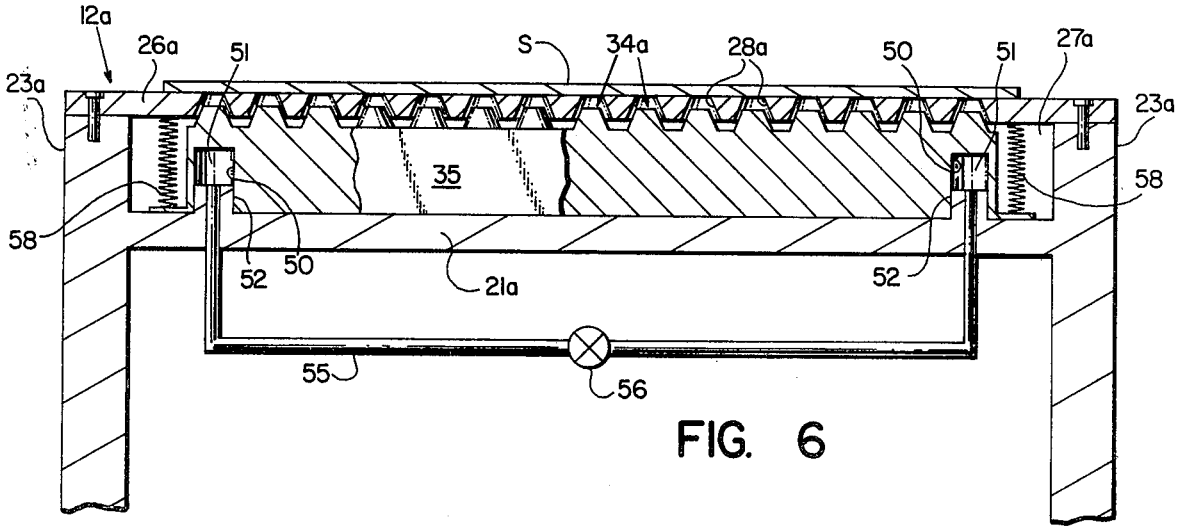
FIG. 6 is a fragmentary sectional view taken along the line 6—6 of FIG. 5.

A typical closure bar 35, shown in FIG. 6, has at its opposite ends blind downwardly opening generally cylindrical bores 50, 50 which define piston chambers 51, 51. Each bore 50 receives a complementary cylindrical upwardly projecting guide member 52 mounted in fixed position within the chamber **27*a* on the bottom wall 21. Along the upper surface of the bar 35 there is formed a transversely spaced series of upwardly projecting closure elements 34a, 34a. Each closure element 34a is received within an associated passageway 28a and has a frustoconical upwardly converging seating Burface 36a which complements an associated valve seat defined by the passageway 28a. At its upper end each closure element has a closure surface 42a**.

Figure 7:
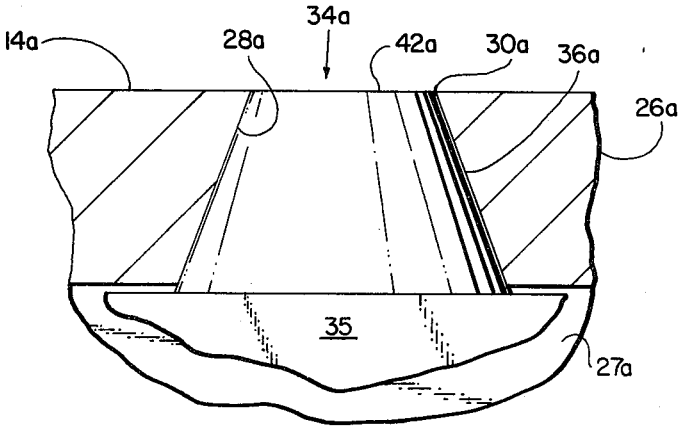
FIG. 7 is a somewhat enlarged fragmentary sectional view of a portion of the apparatus of FIGS. 5 and 6 as shown in FIG. 6.

Each closure bar 35 is movable between an open position and a closed position relative to an associated row of openings 30a, 30a. When the closure bar is in its raised or closed position the upper surfaces 42a, 42a of the various closure elements or poppet valves carried by the bar are disposed generally within the plane of the bearing surface 14a and form closures for the various openings 30a, 30a. When the closure bar 35 is in its closed position, as it appears in FIG. 7, the closure surfaces 42a, 42a thereof are generally flush with the bearing surface 14a and cooperate with the bearing surface to provide a substantially smooth uninterrupted surface over which the cutter wheel 16a may move to assure complete cutting of sheet material positioned thereon. A vacuum source 46a is connected in communication with the chamber 27a by a conduit 48a to apply vacuum to the bearing surface 14a through the various rows of openings 30a, 30a, when associated closure bars, 35, 35 are in lowered or open positions.

Pneumatic means is provided for simultaneously closing the openings 30a, 30a in at least one of the rows in response to movement of the cutter wheel 16a to a predetermined position relative to one of the openings in the one row. In the illustrated embodiment 10a the pneumatic means comprises a source of air under pressure, indicated schematically by the numeral 54, and a conduit 55 for connecting the air pressure source 54 through a series of valves 56, 56 to the piston chambers 51 at the opposite ends of each closure bar 35. A cam 57, shown schematically in FIG. 5, carried by a carriage assembly 18a, similar to the carriage assembly 18 of FIG. 1, sequentially operates one or more of the valves 56, 56 as the carriage assembly moves longitudinally of the table assembly 12a or in the X-coordinate direction. As each valve 56 is operated, air under pressure is simultaneously admitted to the piston chambers 51, 51 at opposite ends of an associated closure bar 35 whereby the closure bar is raised to its closed position. The cam 57 is arranged to maintain a single valve 56 or a plurality of valves in open position until the cutter wheel 16a has passed over and moved to a predetermined position beyond an associated opening whereby the cam allows the associated valve or valves to shift to an exhaust position exhausting air from the piston chambers 51, 51 and allowing the closure bar or bars to drop to open position under the influence of gravity. Alternatively, biasing means, such as springs 58, 58, shown in FIG. 6, may be provided for normally biasing each closure bar to its open position.

I claim:

1. In an apparatus for cutting sheet material and having means defining a bearing surface for supporting sheet material to be cut, said bearing surface having openings therein, a cutting instrument, means for moving the cutting instrument in cutting engagement with the bearing surface to cut sheet material spread thereon, a vacuum source, and means communicating with said vacuum source and with said openings for applying vacuum to sheet material spread on said bearing surface, the improvement comprising closure elements movable between open and closed positions relative to said openings for opening and closing said openings, said closure elements having closure surfaces for cutting engagement with said cutting instrument when said closure elements are in said closed positions, and means for moving at least one closure element to its closed position relative to an associated one of said openings in response to movement of said cutting instrument to a predetermined position relative to said one opening.

2. In an apparatus for cutting sheet material as set forth in claim 1 the further improvement wherein each closure element has a peripheral edge defining the closure surface thereof and generally contiguous to the boundary edge of an associated opening when the closure element is in its closed position.

3. In an apparatus for cutting sheet material as set forth in claim 2 the improvement wherein said closure surfaces are disposed generally within the plane of said bearing surface when said closure elements are in said closed positions.

4. In an apparatus for cutting sheet material as set forth in any one of claims 1 through 3 the further improvement wherein said apparatus includes means for biasing said closure elements toward said open positions.

5. In an apparatus for cutting sheet material as set forth in claim 4 the further improvement wherein said biasing means comprises elastomeric means.

6. In an apparatus for cutting sheet material as set forth in claim 5 the further improvement wherein said elastomeric means comprises a sheet of elastomeric material disposed below said bearing surface.

7. In an apparatus for cutting sheet material as set forth in claim 4 the further improvement wherein said biasing means comprises a spring.

8. In an apparatus for cutting sheet material as set forth in claim 4 wherein said biasing means comprises said communicating means.

9. In an apparatus for cutting sheet material as set forth in claim 8 the further improvement wherein said means defining said bearing surface comprises a plate and said elastomeric means comprises a fluid permeable elastomeric sheet disposed below said plate.

10. In an apparatus for cutting sheet material as set forth in any one of claims 1 through 3 the further improvement wherein said closure elements comprises poppet valves.

11. In an apparatus for cutting sheet material as set forth in any one of claims 1 through 3 the further improvement wherein said cutting instrument comprises said means for moving said one closure element.

12. In an apparatus for cutting sheet material as set forth in claim 11 the further improvement wherein said cutting instrument comprises a cutting wheel.

13. In an apparatus for cutting sheet material as set forth in any one of claims 1 through 3 the further improvement wherein said closure surfaces are disposed above said bearing surface when said closure elements are in said open position.

14. In an apparatus for cutting sheet material as set forth in any one of claims 1 through 3 the further improvement wherein said closure surfaces are disposed below said bearing surface when said closure elements are in said open positions.

15. In an apparatus for cutting sheet material as set forth in any one of claims 1 through 3 the further improvement wherein said means for moving said one closure element comprises pneumatic means.

16. In an apparatus for cutting sheet material as set forth in claim 15 the further improvement wherein said closure elements are maintained in said open position by the force of gravity.

17. In an apparatus for cutting sheet material as set forth in claim 15 wherein said closure elements are maintained in open position by biasing springs.

18. In an apparatus for cutting sheet material as set forth in claim 15 the further improvement wherein said means for moving said one closure element includes valve means for activating said pneumatic means and means in the path of said instrument moving means for operating said valve means.

19. In an apparatus for cutting sheet material as set forth in any one of claims 1 through 3 the further improvement wherein said means for moving said one closure element is further characterized as means for simultaneously moving a plurality of said closure elements.

20. In an apparatus for cutting sheet material as set forth in claim 18 the further improvement wherein said means for simultaneously moving said closure elements comprises pneumatic means.

21. In an apparatus for cutting sheet material as set forth in claim 20 the further improvement wherein said means for simultaneously moving said closure elements comprises valve means for operating said pneumatic means and a cam for actuating said valve means.

22. In an apparatus for cutting sheet material as set forth in claim 1 wherein said apparatus has a table assembly including a table having a bottom wall, a pair of end walls and a pair of side walls, said table further including a base plate supported by said side and said end walls and releasably secured thereto, said base plate defining said bearing surface and cooperating with said bottom, side and end walls to define a vacuum chamber, said means communicating with said vacuum source also communicating with said vacuum chamber.

* * * * *